United States Patent [19]

Ito

[11] 4,164,792

[45] Aug. 21, 1979

[54] DEVICE FOR TIGHTENING THE WAIST OF A GARMENT

[76] Inventor: Mitsuru Ito, 322 E. 55th St., Apt. 3B, New York, N.Y. 10022

[21] Appl. No.: 819,034

[22] Filed: Jul. 25, 1977

[30] Foreign Application Priority Data

Aug. 31, 1976 [JP] Japan ..... 51/115800[U]

[51] Int. Cl.[2] ..... A41D 1/02

[52] U.S. Cl. ..... 2/108; 2/221; 2/237

[58] Field of Search ..... 2/108, 267, 105, 316, 2/219, 221, 237, 238, 76; 150/1

[56] References Cited

U.S. PATENT DOCUMENTS 1,199,933 10/1916 Seccenbaugh ..... 2/221

2,092,152 9/1937 Daniel ..... 2/237

3,161,890 12/1964 Betz ..... 2/237

FOREIGN PATENT DOCUMENTS 23203 11/1917 Austria ..... 2/221

*Primary Examiner*—Werner H. Schroeder

*Assistant Examiner*—Doris L. Troutman

*Attorney, Agent, or Firm*—Ladas, Parry, Von Gehr, Goldsmith & Deschamps

[57] ABSTRACT

A device for tightening the waist of a garment comprising a sheath provided around the waist of a garment which has an opening near each end thereof and a pair of strings, each of which is secured to one end of said sheath and is passed through the sheath and drawn out of the opening at the other end thereof is disclosed.

9 Claims, 4 Drawing Figures

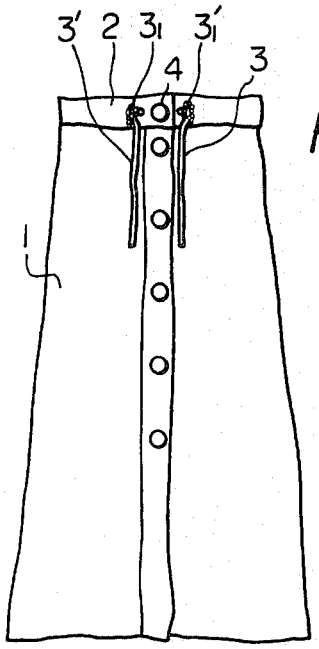
Fig. 3
Fig. 4
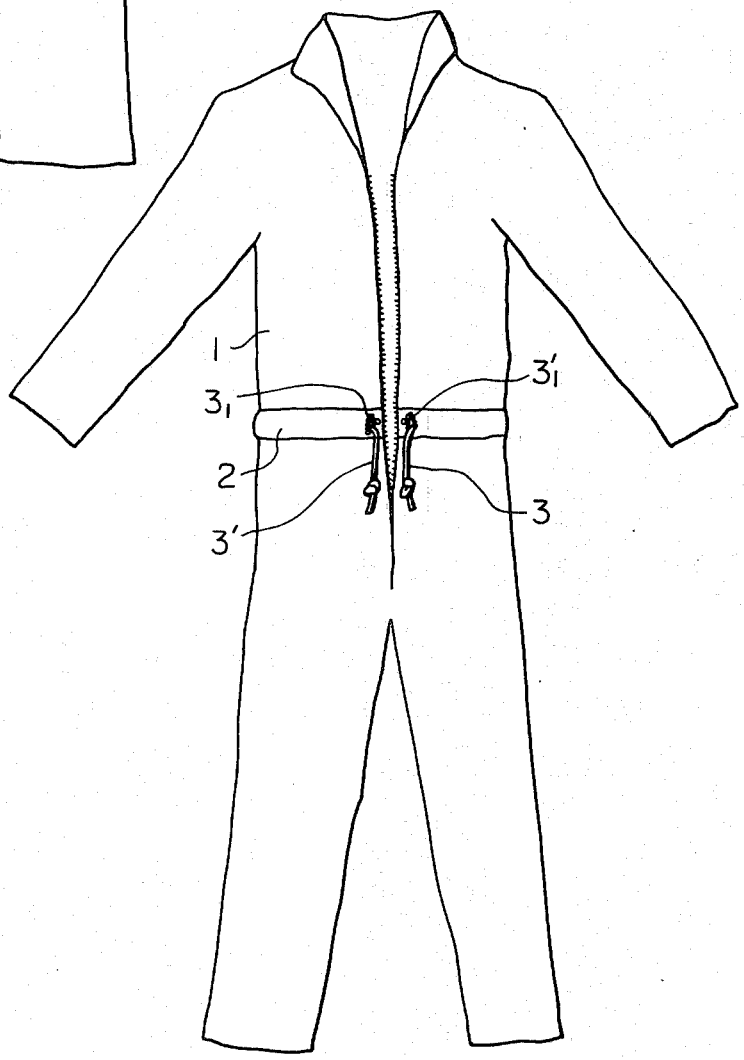

DEVICE FOR TIGHTENING THE WAIST OF A GARMENT

BACKGROUND OF THE INVENTION

This invention relates to a device for tightening the waist of a garment, such as coat, jacket, shirt, trousers, skirt, one-piece dress, overcoat, overall, etc. More particularly, this invention relates to a device to pull the waist of such a garment into a gathered state.

In the prior art, for the purpose of tightening the waist of such a garment, a single string which is slidably inserted in a tubular hem or sheath provided at the waist and each end whereof is drawn out from an opening provided at each end of said hem or sheath is used. However, in tightening the waist by pulling the two ends of such a string, the waist cannot be pulled into gathers. Therefore, the wearer has to hold the opening of the hem or sheath with one hand so that the gathers are formed while the other hand is drawing the string. When the garment is a lumber jacket, coat, overall, etc., which are made of thick cloth, it is not only inconvenient but also difficult to tighten the waist. And the string is simply slidably placed in the tubular hem or sheath, and therefore the string end is often drawn into the tubular hem or sheath when the garment is taken off.

With the aim is eliminating these defects of the prior art drawstring of the garment, I intended to improve the tightening device for garments by applying the principle of the drawstring for the opening and closing of clothbags. Said drawstring goes round the opening of the bag twice forming a double ring. With such a drawstring the opening forming is easily closed uniform gathers by drawing out the two ends thereof.

However, if such a drawstring for a bag is applied to a garment as is, the drawstring completely encircles the waist of the garment and therefore the front parts of the garment cannot be opened. So, I have created a new device for tightening the waist of a garment by using two strings, each of which is secured to one end of the tubular hem or sheath of the garment waist and is passed through the tubular hem or sheath and is drawn out from an opening at the other end of the tubular hem or sheath of a garment.

SUMMARY OF THE INVENTION

In accordance with this invention, a device for tightening the waist of a garment comprising a tubular hem or sheath provided at the waist of a garment which has an opening near each end thereof and a pair of strings, each of which is secured to one end of said tubular hem or sheath and is passed through the tubular hem or sheath and drawn out of the opening at the other end of the tubular hem or sheath is provided. Hereinafter the term "sheath" is used as including "tubular hem".

This device is usually used in combination with a known fastening means such as button, hook, etc., which fastens the two front parts of a garment. The waist provided with this device can easily be tightened by drawing the ends of the two strings and tying. The strings are never drawn into the sheath even if the waist of the garment is stretched. If the wearer makes decorative knot in the front, it gives a fashionable effect to the garment.

In this invention, it must be understood that the term "string" encompasses cord, braid, narrow belt, etc. that are equivalent of string.

BRIEF EXPLANATION OF THE ATTACHED DRAWINGS

Now the invention is explained in detail in regard of some embodiments with reference to the attached drawings.

FIG. 3 is a front view of a skirt to which a device in accordance with this invention is applied.

FIG. 4 is a front view of an overall to which a device in accordance with this invention is applied.

DETAILED DESCRIPTION OF THE INVENTION

Figure 1:
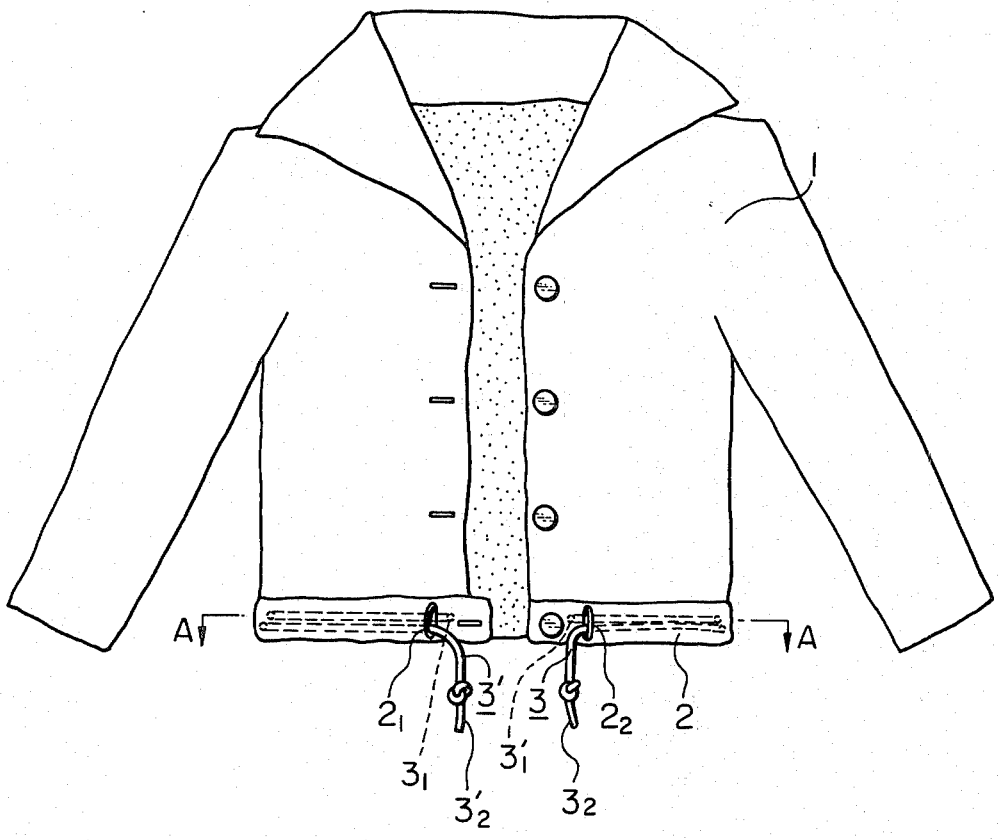
FIG. 1 is a front view of a lumber jacket to which a device in accordance with this invention is applied.
Figure 2:
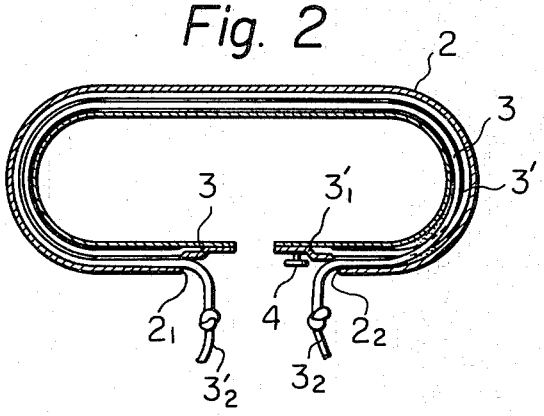
FIG. 2 is a cross-sectional view along line A—A in FIG. 1.

FIGS. 1 and 2 represent an embodiment of this invention. A garment (a lumber jacket in this case) is generally indicated by 1. Member 2 is a strip of fabric, which is applied to the outside of the waist of the jacket so as to form a sheath. At the ends of the strip, a pair of openings $2_1$ and $2_2$ are provided. A pair of strings 3 and 3' are passed through the sheath and each one of them is secured to the ends of the sheath $3_1$ and $3_1'$ and the other end of each of them is drawn out from the opening $2_2$ and $2_1$.

The jacket has a button 4 at the waist or sheath as seen in FIG. 2 (a button hole is not shown). When the jacket is put on by a person, the waist is buttoned. And the drawn-out ends of the strings $3_2$ and $3_2'$ are pulled, then the two strings tighten the waist forming uniform gathers in the waist, since the other ends of the strings go round the wasit and are secured to the waist end at the other ends. The wearer may tie the drawn-out ends of the strings.

When the jacket is taken off, the string ends are untied and the waist is stretched. Then the strings are drawn into the sheath, and the waist is unbuttoned. The strings are not completely drawn into the sheath but some length thereof remains outside of the sheath, since the length of the strings is longer than the length of the waist and one end thereof is secured to one end of the waist.

The device of this invention can also be applied to other kinds of garment such as skirt or overall as shown in FIGS. 3 and 4. It is needless to say that this can be applied to shirt, one-piece dress, trousers, overcoat, etc. The drawings are self-explanatory and no further verbal explanation will be required. The same reference number represents the same member or the corresponding member as in FIGS. 1 and 2.

Those skilled in the art will understand that this invention can be applied to various articles of clothing in various ways. The sheath for the binding strings can be formed in various ways. It can be formed simply by folding back the lower edge of a jacket and sewing the edge to the jacket to form a tubular hem. It can be formed by applying a strip of fabric to the outside or inside of the waist of a garment to form a sheath. Or, a sheath can be made by simply forming two parallel stitching lines at the waist of a garment which sew together the outer cloth and the lining of a garment.

All the illustrated examples represent embodiments in which the openings are provided in the front part of a garment. But the device of this invention undoubtedly can be applied to garments the body part of which is opened at the back.

Having described my invention, I claim:

1. A device for tightening the waist of a garment which is separated and opened in the front of the wearer's body, comprising a sheath which is provided around the waist of the garment and terminates at its opposite ends in respective openings at either side of the garment opening, a first string which is secured to the sheath adjacent to one of the two openings thereof and which passes through the sheath and out of the sheath through the other opening thereof, and a second string which is secured to the sheath adjacent said other opening thereof and passes through the sheath and out of the sheath through said one opening thereof.

2. The device as set forth in claim 1, in which the sheath is a tubular hem of the garment.

3. The device as set forth in claim 1, in which the sheath is provided by applying a strip of fabric on the inside of the garment.

4. The device as set forth in claim 1, in which the sheath is provided by applying a strip of fabric on the outside of the garment.

5. The device as set forth in claim 1, in which the sheath is provided by sewing together the outer cloth and the lining with two parallel stitching lines.

6. The device as set forth in claim 1, which is applied to a jacket.

7. The device as set forth in claim 1, which is applied to a coat.

8. The device as set forth in claim 1, which is applied to a skirt.

9. The device as set forth in claim 1, which is applied to an overall.

* * * * *